US007242263B2

(12) United States Patent
Kroening

(10) Patent No.: US 7,242,263 B2
(45) Date of Patent: Jul. 10, 2007

(54) TRANSFORMER-FREE WAVEGUIDE CIRCULATOR

(75) Inventor: Adam M. Kroening, Atlanta, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 11/084,304

(22) Filed: Mar. 18, 2005

(65) Prior Publication Data

US 2005/0179504 A1 Aug. 18, 2005

Related U.S. Application Data

(60) Provisional application No. 60/554,316, filed on Mar. 18, 2004.

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,221,255 | A | | 11/1965 | Rabowsky et al. |
| 3,277,339 | A | | 10/1966 | Simon |
| 3,339,158 | A | | 8/1967 | Passaro |
| 3,341,789 | A | * | 9/1967 | Goodman et al. ..... 333/1.1 |
| 3,350,663 | A | | 10/1967 | Siekanowicz et al. |
| 3,530,387 | A | | 9/1970 | Bonfeld et al. |
| 3,582,831 | A | | 6/1971 | Siekanowicz et al. |
| 3,710,280 | A | | 1/1973 | Buck |
| 3,806,837 | A | | 4/1974 | Carr et al. |
| 4,058,780 | A | | 11/1977 | Riblet |
| 4,697,158 | A | | 9/1987 | Hoover et al. |
| 5,608,361 | A | | 3/1997 | Weiss |
| 5,724,010 | A | | 3/1998 | Brown |
| 2003/0107447 | A1 | | 6/2003 | Kroening |

FOREIGN PATENT DOCUMENTS

| | | |
|---|---|---|
| JP | 53135552 | 11/1978 |
| JP | 5620301 | 2/1981 |
| JP | 200082901 | 3/2000 |
| JP | 2000332507 | 11/2000 |
| WO | 02/067361 | 8/2002 |

* cited by examiner

*Primary Examiner*—Stephen E. Jones
(74) *Attorney, Agent, or Firm*—Hogan & Hartson LLP

(57) ABSTRACT

An improved waveguide circulator that eliminates the need for quarter-wave dielectric transformers or impedance steps in the interface waveguide for broadband operation is described. The circulator designs in the prior art all require impedance matching elements outside of the ferrite element in order to achieve acceptable performance. Through the use of this new invention, broadband circulator performance can be achieved without the addition of impedance matching elements in order to minimize the cost, size, mass, and loss of the circulator.

16 Claims, 7 Drawing Sheets

TRANSFORMER-FREE WAVEGUIDE CIRCULATOR

CROSS REFERENCE TO RELATED APPLICATION

The present application claims the priority benefit of U.S. provisional patent application Ser. No. 60/348,194 filed Nov. 7, 2001, U.S. non-provisional patent application Ser. No. 10/289,460 filed Nov. 7, 2002, and U.S. provisional patent application Ser. No. 60/554,316, filed Mar. 18, 2004, and incorporates the same herein by reference.

BACKGROUND OF THE INVENTION

1. Field of the Invention

The invention relates in general to waveguide circulators for the non-reciprocal transmission of microwave energy; and more particularly to a novel approach for reducing the size, insertion loss, and cost of a waveguide switching circulator.

2. Description of the Related Art

Ferrite circulators have a wide variety of uses in commercial and military, space and terrestrial, and low and high power applications. A waveguide circulator may be implemented in a variety of applications, including but not limited to low noise amplifier (LNA) redundancy switches, T/R modules, isolators for high power sources, and switch matrices. One important application for such waveguide circulators is in space, especially in satellites where extreme reliability is essential and where size and weight are very important. Ferrite circulators are desirable for these applications due to their high reliability, as there are no moving parts required. This is a significant advantage over mechanical switching devices. In most of the applications for waveguide switching and non-switching circulators, small size, low mass, and low insertion loss are significant qualities.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for switching the microwave signal from one waveguide arm to another. By reversing the direction of the magnetizing field, the direction of switching between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

Generally, these three-port waveguide switching circulators are impedance matched to an air-filled waveguide interface. For the purposes of this description, the terms "air-filled," "empty," "vacuum-filled," or "unloaded" may be used interchangeably to describe a waveguide structure. Conventional three-port waveguide switching circulators typically have one or more stages of quarter-wave dielectric transformer structures for purposes of impedance matching the ferrite element to the waveguide interface. The dielectric transformers are typically used to match the lower impedance of the ferrite element to the higher impedance of the air-filled waveguide so as to produce low loss. There are several disadvantages to using transformers in such a manner. When dielectric transformers are used, RF losses can be introduced in various ways, such as the following: losses in the dielectric material itself, increased losses in the waveguide surfaces due to the high concentration of RF currents on the metal waveguide surfaces disposed directly above and below the dielectric transformer element, and losses in the adhesives typically used to bond the transformers to the conductive housing. Importantly, the use of dielectric transformers also takes up additional space in the waveguide structure, thereby increasing the minimum size and weight of the circulator.

Previous patents (U.S. Pat. No. 4,697,158; U.S. Pat. No. 3,277,399; U.S. Pat. No. 4,058,780, Pub. No. WO 02/067361 A1) have described approaches for achieving broad bandwidth through the addition of impedance matching elements. Broadband circulators have high isolation and return loss and low insertion loss over a wide frequency band, which is desirable so that the circulator is not the limiting component in the frequency bandwidth of a system. Broad bandwidth also allows a single design to be reused in different applications, thereby providing a cost savings. These prior art approaches for achieving broad bandwidth generally involve the addition of quarter-wave dielectric transformers or steps in the height or width of the waveguide structure to thus achieve impedance matching of the ferrite element to the waveguide port. For example, U.S. Pat. No. 4,697,158 discloses achieving impedance matching by providing a step or transition in the waveguide pathway. This technique eliminates the standard dielectric transformers, but is very sensitive to dimensional variations, resulting in a design that is difficult and expensive to manufacture reliably. This design also relies on the presence of a significant gap or spacing between adjacent ferrite elements, increasing the size and weight of the structure. These methods all require impedance matching elements in addition to the ferrite element in order to achieve acceptable performance. Other patents, such as U.S. Pat. No. 5,724,010, discuss changing the shape of the ferrite resonant structure to achieve broadband performance. However, these ferrite structures are restricted to fixed-bias applications with a single direction of circulation. Lastly, my co-pending patent application, Publication US2003/0107447 titled MUILTI-JUNCTION WAVEGUIDE CIRCULATOR WITHOUT INTERNAL TRANSITIONS (the '7447 application publication), incorporated herein by reference, describes implementations wherein the impedance matching elements have been eliminated between adjacent ferrite elements by careful selection of the width of the waveguide pathway in the region of the ferrite elements and the use of a de minimis air gap (less than a fraction of a wavelength) between the adjacent ferrite elements. That application, however, describes use of conventional quarter wavelength dielectric transformers for those protruding parts of the circulator (which in a Y-shaped element are referred to as legs) not directly adjacent to another protruding part of an adjacent circulator. The '7447 application claims many of the same benefits of improvements in size, loss, and complexity of this new invention, but the prior approach utilizes the symmetry in the adjacent ferrite elements for impedance matching. This technique is only applicable between two adjacent ferrite elements, and the embodiments disclosed therein still utilize the traditional quarter-wave dielectric transformers for impedance matching in the circulator legs that do not face or abut an adjoining ferrite junction. Accordingly, it can be seen that a need yet remains in the art for a circulator with reduced size, weight, and cost and which can avoid the need for separate elements for impedance matching. Therefore, the present invention is directed to providing such a broadband switching circulator wherein performance can be achieved between a ferrite junction and a waveguide port interface without the addition of impedance matching elements.

SUMMARY OF THE INVENTION

Briefly stated, the present invention is a waveguide circulator that eliminates the need for additional impedance matching circuitry or elements to provide a broadband impedance match between ferrite elements and an air-filled waveguide. The waveguide circulator in accordance with the invention eliminates the need for additional parts or features and thus reduces insertion loss, size, and mass. Specifically, this invention eliminates the loss associated with quarter-wavelength dielectric transformer sections and the adhesive used in the assembly of such, and eliminates the additional size and mass required for the dielectric or air-filled waveguide transitional sections. The lower parts count also results in a savings of time and parts cost. Furthermore, it will be seen that the frequency bandwidth of the present invention is comparable to, if not broader than, that of the present art, with one exemplary prototype yielding a bandwidth of over 20% at the 21 dB isolation point and another exemplary prototype yielding a bandwidth of over 40% at the 14 dB isolation point, both at K-band. The percent bandwidth is defined as 100 times the frequency span for which a minimum requirement, such as 21 dB of isolation, is met, and divided by the average of the minimum and maximum frequency values for which the requirement is met.

In an illustrative form, the present invention comprises an improved waveguide circulator that eliminates the need for quarter-wave dielectric transformers or impedance steps in the interface waveguide for broadband operation. The illustrative embodiment employs a relatively tall, relatively thin ferrite element having a high saturation magnetization value to achieve good, broadband circulator performance without the addition of impedance matching elements in order to minimize the size, mass, and loss of the circulator.

In another embodiment, the present invention comprises a multi-junction ferrite waveguide circulator including a waveguide structure having an internal cavity. The waveguide structure includes a plurality of ports extending from the internal cavity. Notably, the ports are free from any steps in height or width or any quarter wavelength dielectric transformers, such as are sometimes used in the prior art to achieve impedance matching. Additionally, the internal transitions between ferrite elements do not include any quarter wavelength transformer sections, which would significantly impact the size, mass, and loss of the device. To achieve good impedance matching, the ferrite element is made of a ferrite material having a relatively high saturation magnetization value such that waveguide port steps (or ridges in the waveguide structure) and dielectric transformers can be omitted while still providing good impedance matching to the waveguide port interfaces.

Preferably, the ferrite element is Y-shaped with its protruding parts being referred to as "legs", although persons skilled in this art will recognize that other shapes can be utilized as desired. Also, the circulator can be combined with other such circulators in a larger switch or other device. Because the circulator can be constructed without the dielectric transformers, the individual circulators can be significantly smaller, lighter, and less costly. When a number of these smaller, lighter, less costly circulators are integrated together in a larger device, the savings in size, weight, and cost can be substantial.

The implementation of the invention in the application of a switching circulator based on a Y-shaped ferrite element requires an analysis of the impedance of the center resonant section of the ferrite element, the three legs that serve as return paths for the bias fields in the resonant section, and the dielectric spacers that serve to properly position the ferrite element in the waveguide housing. Because the dimensions of the legs of the ferrite element serve to close the magnetic circuit of the resonant section, the prior art has required the implementation of additional matching structures in order to achieve a broadband match of the ferrite element out to the waveguide interfaces. In the application of this invention, broadband performance is achieved through impedance matching of the resonant section of the ferrite element and its associated dielectric spacers to the three legs of the ferrite element that serve as return legs for the magnetic bias circuit of the resonant ferrite section.

According to one embodiment of the invention, a broadband impedance match (better than 5% of frequency bandwidth at the 21 dB isolation point or better than 20% frequency bandwidth at the 14 dB isolation point) is obtained from the interface waveguide port to a ferrite circulator element with the dielectric spacers commonly used to center the ferrite elements along the height of the waveguide. This performance is attained without the use of quarter-wave dielectric transformers or steps in the height or width of the waveguide structure. In addition, the invention contemplates that empirical tuning elements may be employed for adjustments to the impedance match, just as they are used in the prior art designs that include the additional dielectric transformers and waveguide steps. It is important to note that the invention can be applied to different structures that include switching or fixed circulators as building blocks. Examples include the following: an isolator comprised of a fixed or switching circulator with one port terminated in a matched load, a triad switch assembly comprised of one switching circulator and two switching or non-switching isolators, a dual redundant LNA assembly comprised of two switch triads and two LNAs, and an "i"-to-"j" switch matrix with the number of circulators and load elements dependent on the values of "i" and "j".

Thus, it is an aspect of the invention to provide a single junction broadband ferrite circulator that eliminates additional matching sections such as quarter-wave dielectric transformers or steps in the height or width of the waveguide structure while achieving either an isolation of at least 21 dB over a frequency bandwidth of at least 5% or an isolation of at least 14 dB over a frequency bandwidth of at least 20%.

It is another aspect of the invention to provide a waveguide circulator with ferrite elements formed in a number of operable shapes, including a Y-shape, a triangular shaped or a cylindrical shape.

It should be understood that both the foregoing general description and the following detailed description are exemplary and explanatory, and provide further explanation of the invention as claimed.

BRIEF DESCRIPTION OF THE DRAWINGS

The accompanying drawings, which are included to provide a further understanding of the invention and are incorporated in by reference, illustrate embodiments of the invention. Together with the written description, these drawings serve to explain the principles of the invention. In the drawings.

DETAILED DESCRIPTION OF THE PREFERRED EMBODIMENTS

Figure 1:
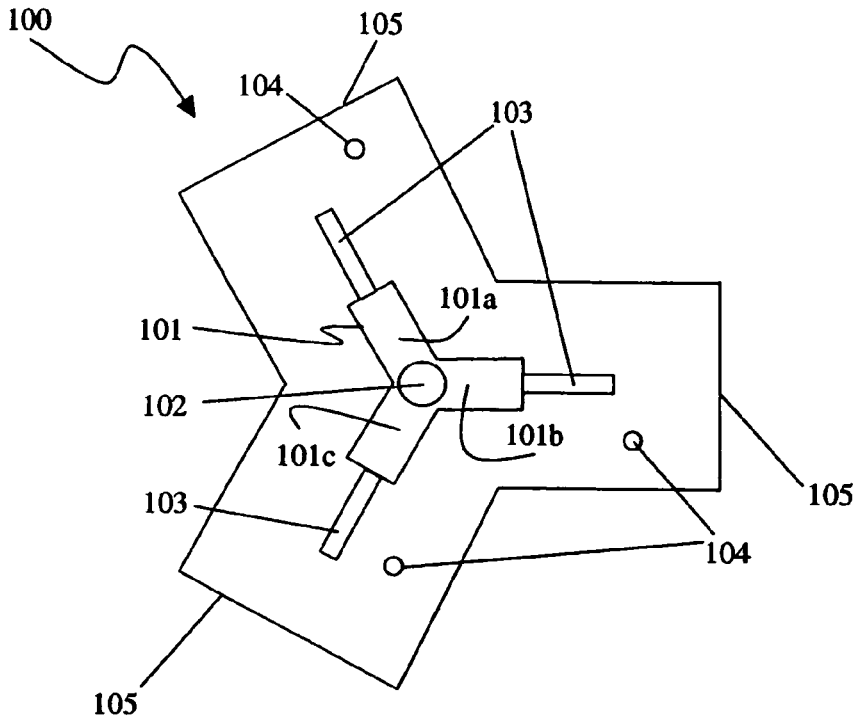
Figure 1 (PRIOR ART)
FIG. 1 shows a conventional single-junction waveguide circulator structure employing a quarter-wave dielectric transformer.

FIG. 1 is a top view of a conventional waveguide circulator structure 100, using a Y-shaped ferrite element 101 with a quarter-wave dielectric transformer 103 attached to and extending from each leg. A dielectric spacer 102 is disposed on the top surface of the ferrite element 101. The dielectric spacer is used to properly position the ferrite element in the housing and to provide a thermal path out of the ferrite element for high power applications. Generally, a second dielectric spacer would be used, located underneath the ferrite element, hidden in this view. All of the components described above are disposed within the conductive waveguide structure 100. The conductive waveguide structure is generally air-filled and also includes waveguide input/output ports 105 that provide interfaces for signal input and output. Empirical matching elements 104 may be disposed on the surface of the conductive waveguide structure 100 to improve the impedance matching. The matching elements are generally capacitive/inductive dielectric or metallic buttons that are used to empirically improve the impedance match over the desired operating frequency band.

Figure 2:
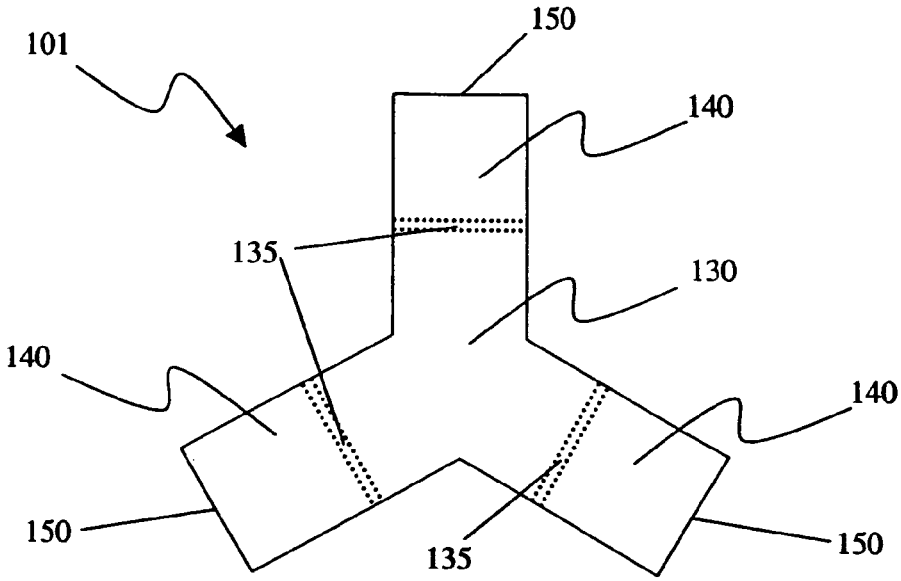
Figure 2 (PRIOR ART)
FIG. 2 shows a conventional ferrite element.

FIG. 2 shows a ferrite element 101 as used in the conventional structure shown in FIG. 1. This figure is used to define the terminology concerning the ferrite element 101. Although magnetizing windings are not shown in this view, dashed lines 135 denote the apertures for the magnetizing windings. These apertures 135 are created by boring a hole through each leg of the ferrite element. If a magnetizing winding is inserted through the apertures, then a magnetizing field can be established in the ferrite element. The polarity of this field can be switched back-and-forth by the application of current on the magnetizing winding to create a switchable circulator. The portion of the ferrite element where the three legs of the element converge and to the inside of the three apertures 135 is the resonant section of the ferrite element 130. The dimensions of this section determine the operating frequency for circulation in accordance with conventional design and theory. The three protruding sections, or legs 140, of the ferrite element to the outside of the magnetizing winding apertures 135 act both as return paths for the bias fields in the resonant section 130 and as impedance transformers out of the resonant section. The faces 150 of the ferrite element are located at the outer edges of the three legs.

Although the exemplary embodiments of the invention will next be described with respect to a latching circulator switch junction, such as in FIG. 3, the invention can be applied to a fixed circulator junction that uses a current pulse of only one polarity through the magnetizing winding, or to a circulator for which a permanent magnet is used to bias the ferrite element.

Figure 3:
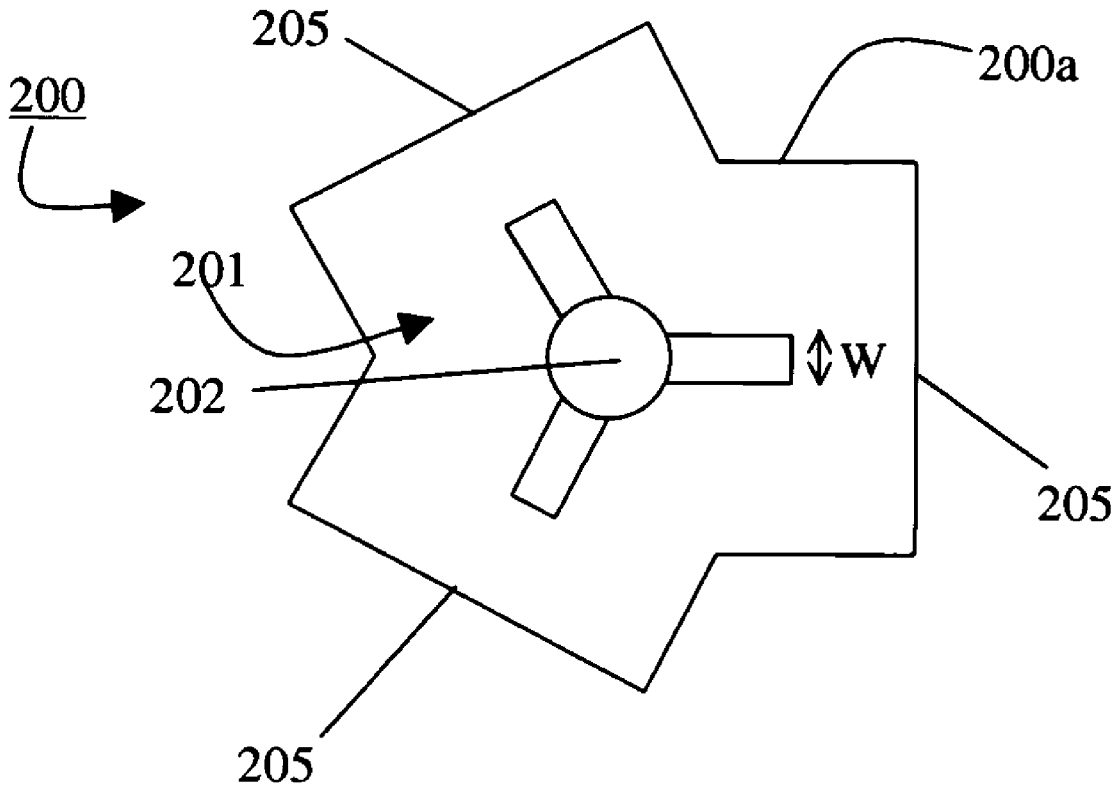
FIG. 3 is a schematic, top view, of a single-junction waveguide circulator structure that does not employ additional matching sections such as quarter-wave dielectric transformers or steps in the height or width of the waveguide structure in accordance with an embodiment of this invention.
Figure 7:
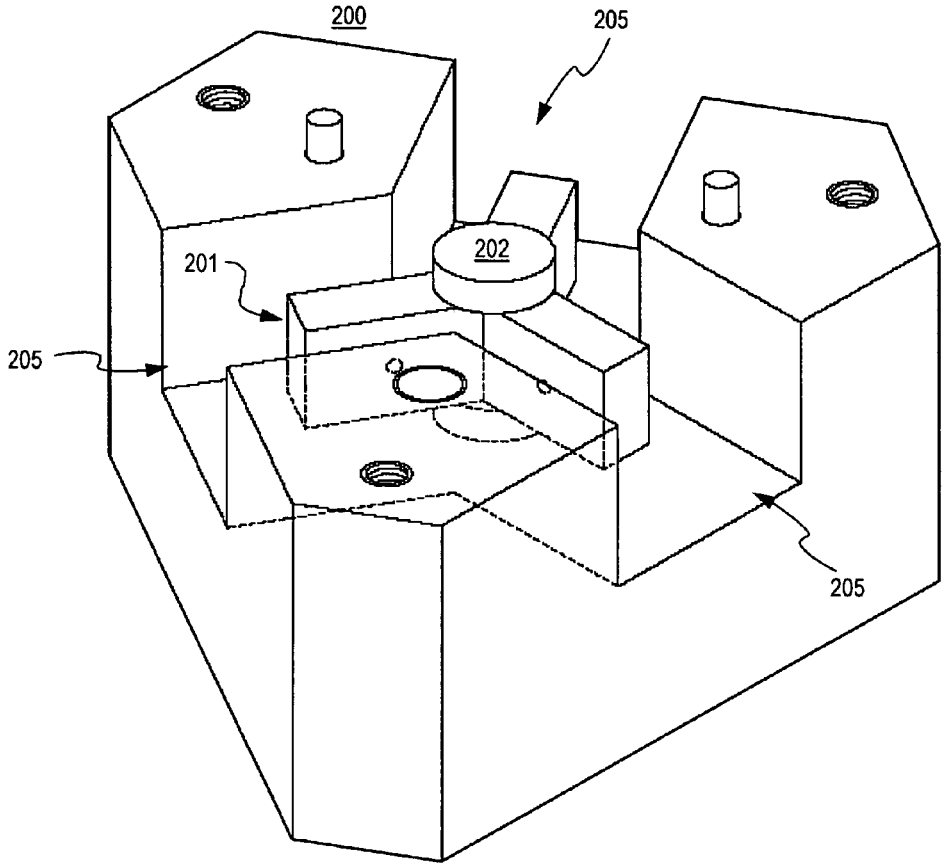
FIG. 7 shows an isometric view of the single-junction waveguide circulator of FIG. 3.

FIG. 3 shows a top view, and FIG. 7 shows an isometric view, of a multi-junction waveguide circulator 200 in accordance with a first embodiment of the invention. It is similar in concept and description to the circulator of FIG. 1, but the quarter-wave dielectric transformer sections are not present. Additionally, there are no steps in the height or width of the waveguide structure. FIGS. 3 and 7 show a ferrite element 201 with a dielectric spacer 202 disposed on its top surface. Generally, a second dielectric spacer would be used, located underneath the ferrite element, hidden in FIG. 3 and shown in phantom in FIG. 7 The ferrite element 201 and dielectric spacers 202 are disposed within the conductive waveguide structure 200. The conductive waveguide structure 200 also includes three waveguide input/output ports 205. Although empirical matching elements are not shown, they may be disposed on the surface of the conductive waveguide structure as in the prior art. It is important to the note that while this embodiment illustrates the ferrite element as having a Y-shape with three legs, the invention also can include a variety of different shapes, including a triangular puck shape. While these shapes may not be considered to have legs as described below, they nevertheless have a particularly protruding portion that may operate in a manner similar to the toroid legs, or toroid protruding portions, described above.

Instead of the conventional method of using both the legs of the ferrite element and the quarter-wave dielectric transformer sections to match the impedance of the waveguide ports to the resonant section of the ferrite, the novel impedance matching approach shown in FIG. 3 requires only the use of the legs of the ferrite element and the dielectric spacers. This impedance matching is performed by careful selection of the ferrite and dielectric spacer material properties and dimensions. In K-band, for example, one embodiment of this invention uses a ferrite material with a saturation magnetization value more than 10% higher than that generally employed in the prior art. Furthermore, the width W of the leg of the ferrite element is more than 10% smaller, and the height of the ferrite element (the distance of the ferrite element that extends into the page for FIG. 3) is more than 10% greater than that of the prior art. However, it is understood that this dimensional relationship can be varied within the scope of the design of this invention, as required for optimum signal transfer with reduced loss and signal reflection. Comparison of FIG. 3 to the prior art of FIG. 1 shows the improvement in size and reduced complexity of the new invention.

Although the final design dimensions are determined empirically through numerical simulations or laboratory measurements, the design procedure for the transformer-free switches is outlined below. First, a ferrite material is selected with a saturation magnetization whose value is more than 180 times the minimum operating frequency (in GHz) and less than 360 times the maximum frequency (in GHz). The saturation magnetization and the dielectric constant of the ferrite material and the dielectric constant of the dielectric spacer material are the inputs for the numerical simulation. The physical dimensions of the height, length, and width of the ferrite element; the diameter of the dielectric spacer; and the height and width of the conductive waveguide structure are then optimized for the input material properties in order to meet the desired RF performance parameters over the desired percent bandwidth.

Figure 4:
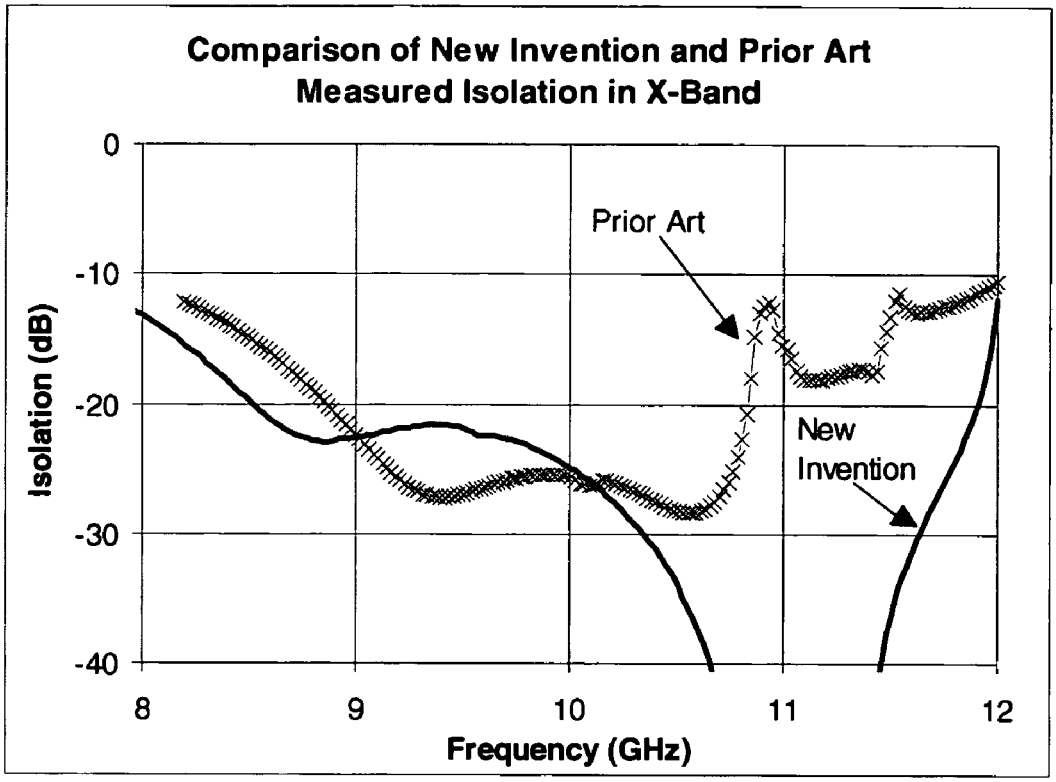
FIG. 4 compares measured data for a prototype of the design as shown in FIG. 3 to measured data for a conventional design as shown in FIG. 1, exemplary of the X-band of operating frequency.
Figure 5:
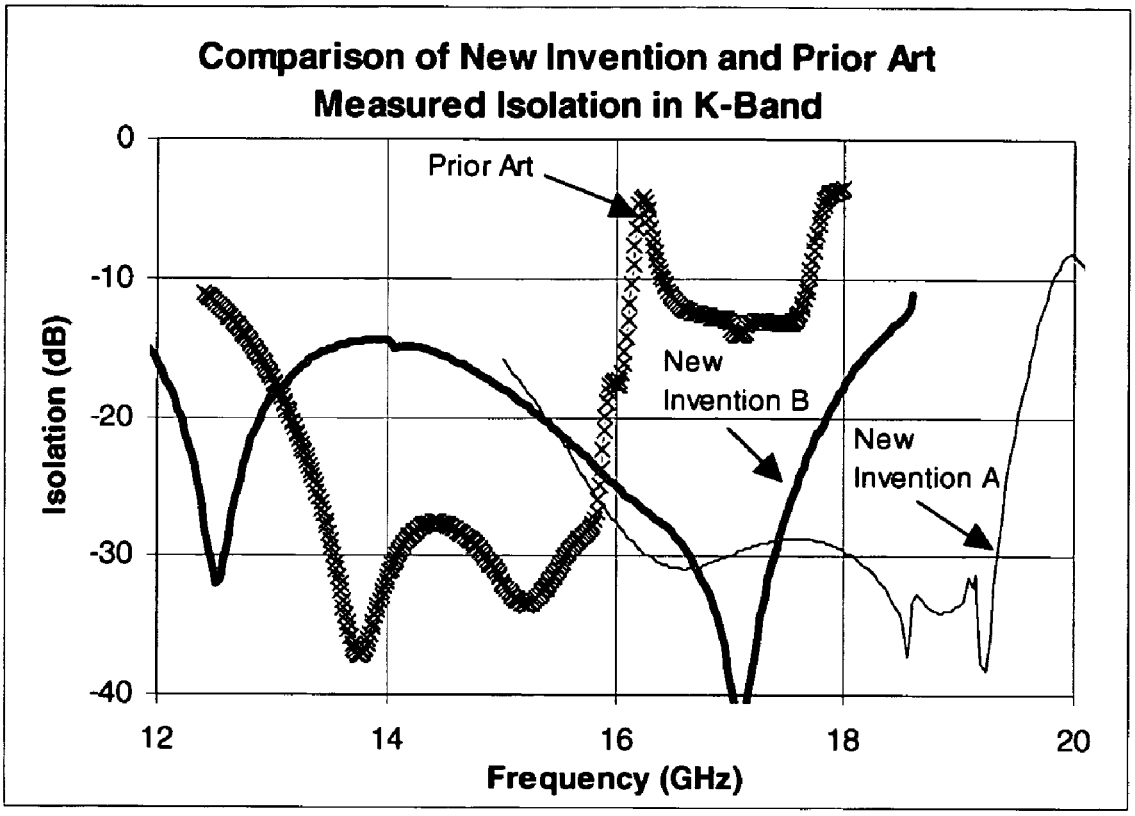
FIG. 5 compares measured data for two different prototypes of the design as shown in FIG. 3 to measured data for a conventional design as shown in FIG. 1, exemplary of the K-band of operating frequency.

Measured data for an exemplary prototype of the invention and the prior art are included in FIG. 4 for X-band operating frequencies. FIG. 4 shows that, beyond the aforementioned improvement in parts count and size reduction, there is also an improvement in the performance. The frequency bandwidth at the 21 dB isolation point improves from 19% in the prior art to 32% with the new invention. FIG. 5 compares the isolation performance of two exemplary prototypes of the new invention to the prior art for K-band frequencies. The frequency bandwidth at the 21 dB isolation point improves from 19% in the prior art to 23% with the prototype defined as "New Invention A." The prototype defined as "New Invention B" shows an ultra-broadband application with slightly reduced performance, yielding an isolation bandwidth of 43% at the 14 dB point.

Figure 6:
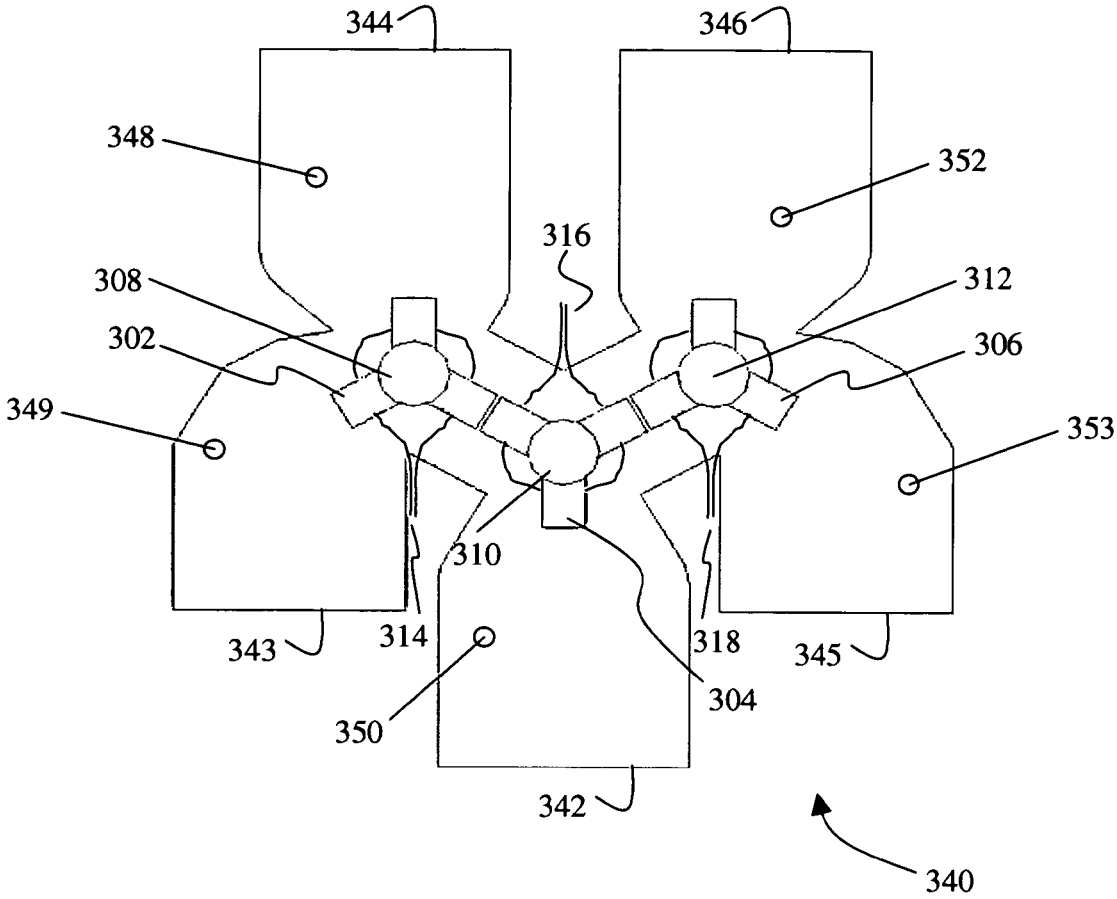
FIG. 6 shows a top view of a multi-junction waveguide circulator use as a switched assembly in accordance with a second embodiment of this invention in which the switching system structure does not employ additional matching sections for impedance matching from the ferrite elements to the waveguide ports.

FIG. 6 shows a top view of a multi-junction waveguide circulator in accordance with a second embodiment of the invention. This circulator configuration is referred to as a single pole, four throw switch network (SP4T). An SP4T switch is comprised of three switching circulators and also referred to as a multi-junction circulator with three ferrite junctions. It is important to note that while the described embodiments illustrate the ferrite element as having a Y-shape with three legs, the invention can also include use of ferrite elements having a variety of differing shapes, including a triangular puck. While these shapes may not be considered to have legs or protruding portions as described above, they nevertheless have a particularly protruding portion which may operate in a manner similar to the toroid legs described above.

FIG. 6 shows a conductive waveguide structure 340 that includes three ferrite elements (also called toroids) 302, 304, and 306 configured in a manner so that at least one leg of each ferrite element is adjacent to one leg of a neighboring ferrite element. Each ferrite element 302, 304, and 306 has three legs and has dielectric spacers 308, 310, and 312, respectively, disposed on its outer surface. Apertures are bored through each leg of the ferrite element 302 so that the magnetized winding 314 can be threaded through each leg of the ferrite element 302. Similarly, ferrite elements 304 and 306 have magnetic windings 316 and 318, respectively, threaded through each leg. Alternatively, the magnetic windings may be threaded through at least one of the ferrite element legs, but not necessarily all three. As shown in FIG. 6, the adjacent legs of ferrite elements 302 and 304 are spaced very closely to one another, leaving a de minimus air gap. Similarly, the adjacent legs of ferrite elements 304 and 306 are disposed closely to one another leaving a de minimus air gap.

All of the components described above are disposed within the conductive waveguide structure 340, and as in the first embodiment, the conductive waveguide structure is generally air-filled. The conductive waveguide structure 340 also includes waveguide input/output ports 342, 343, 344, 345, and 346. The waveguide ports 342, 343, 344, 345, and 346 provide interfaces for signal input and output. As known in the prior art, empirical matching elements 348, 349, 350, 352, and 353 may be disposed on the surface of the conductive waveguide structure 340 to affect the performance. The matching elements are generally capacitive/inductive dielectric or metallic buttons that are used to empirically improve the impedance match over the desired operating frequency band.

One leg of each of ferrite element 304 and two legs of ferrite elements 302 and 306 are impedance matched directly to the waveguide ports 342, 343, 344, 345, and 346, respectively. The impedance matching is achieved through the design of the ferrite elements 302, 304, and 306 and dielectric spacers 308, 310, and 312. There are no quarter-wave dielectric transformers or steps in the height or width of the waveguide structure to provide the impedance matching from the ferrite elements 302, 304, and 306 to the waveguide ports 342, 343, 344, 345, and 346. Thus, as shown in FIG. 6, there are no ferrite-to-air transformers at the two junctions between adjacent legs of the ferrite elements 302, 304 and 306 or at the interfaces from the ferrite elements 302, 304 and 304, 306 to the waveguide ports 342, 343, 344, 345, and 346.

In operation as an SP4T switch, an RF signal is provided as input to the waveguide port 342 and is delivered as output through either waveguide port 343, 344, 345, or 346. The signal enters the waveguide structure 340 through waveguide port 342 and, depending upon the magnetization of ferrite element 304, is directed toward either ferrite element 302 or 306. The direction of signal propagation through a ferrite element can be described as clockwise or counter-clockwise with respect to the center of the ferrite element. For example, if the signal input through waveguide port 342 passes in a clockwise direction through ferrite element 304, it will propagate in the direction of the ferrite element 302. For this signal to continue through ferrite element 302 towards port 344, the magnetization of ferrite element 302 should be established so that the propagating signal passes in the counter-clockwise direction with respect to the center junction of ferrite element 302. The RF signal will thereby exit through waveguide port 344 with low insertion loss. To change the low loss output port from output 344 to a different output 346, a magnetizing current is passed through magnetizing winding 316 so as to cause circulation through ferrite element 304 in the counterclockwise direction, and a magnetizing current is passed through magnetizing winding 318 so as to cause circulation through ferrite element 306 in the clockwise direction. This allows the RF signal to propagate from the input port 342 to the second output port 346 with low insertion loss (effectively ON) and from the input port 342 to the other output ports 343, 344, and 345 with high insertion loss (effectively OFF).

It will be apparent to those skilled in the art that various modifications and variations can be made to this invention without departing from the spirit or scope of the invention. Thus, it is intended that the present invention cover the modifications and variations of this invention provided that they come within the scope of any claims and their equivalents.

I claim:

1. A ferrite waveguide circulator, comprising:

a waveguide structure having an internal cavity, the waveguide structure including a plurality of ports extending from the internal cavity, the ports being free from any steps in height or width; and a ferrite element disposed in the internal cavity and having a plurality of legs matching the number of ports, the legs terminating without any quarter wavelength dielectric transformers extending therefrom, the ferrite element being comprised of a ferrite material having a relatively high saturation magnetization value such that waveguide port steps and dielectric transformers can be omitted while still providing good impedance matching, wherein a broadband impedance match is obtained of greater than 5% of frequency bandwidth at a 21 dB isolation point and/or greater than 20% frequency bandwidth at a 14 dB isolation point.

2. The ferrite waveguide circulator of claim 1, wherein the ferrite element further comprises at least one spacer element.

3. The ferrite waveguide circulator of claim 1 wherein the ferrite element comprises no separate impedance matching element connected to the ferrite element.

4. The ferrite waveguide circulator of claim 1 wherein the legs of the ferrite element are provided with dimensions and a ferrite material composition such that an impedance match between a leg and a corresponding circulator port is obtained without any component being attached to the ferrite element.

5. The ferrite waveguide circulator of claim 1 wherein the legs of the ferrite element are at least 10% thinner and at least 10% taller, in comparison to legs of circulators with dielectric transformers, while still achieving good signal transfer with low loss and signal reflection.

6. The ferrite waveguide circulator of claim 1 further comprising empirical impedance matching elements disposed on the surface of the waveguide structure.

7. A ferrite circulator, comprising: a waveguide structure having an internal cavity, the waveguide structure including a plurality of ports extending from the internal cavity; and a ferrite element disposed in the internal cavity, and wherein a broadband impedance match of greater than a 15% frequency range over which the return loss is greater than 23 dB is achieved without utilizing dielectric transformers or steps in the height and/or width of the waveguide structure.

8. The ferrite circulator according to claim 7, wherein the at least one ferrite element is Y-shaped.

9. The ferrite circulator according to claim 7, further comprising at least one empirical matching element disposed within the internal cavity.

10. A ferrite waveguide circulator, comprising:

a waveguide structure having an internal cavity, the waveguide structure including a plurality of ports extending from the internal cavity, the ports being free from any steps in height or width; and a ferrite element disposed in the internal cavity and having a plurality of legs matching the number of ports, the legs terminating without any quarter wavelength dielectric transformers extending therefrom, the ferrite element being comprised of a ferrite material having a relatively high saturation magnetization value such that waveguide port steps and dielectric transformers can be omitted while still providing good impedance matching, wherein a broadband impedance match is obtained of greater than a 15% frequency range over which the return loss is greater than 23 dB.

11. The ferrite waveguide circulator of claim 10 further comprising empirical impedance matching elements disposed on the surface of the waveguide structure.

12. The ferrite waveguide circulator of claim 10 wherein the legs of the ferrite element are at least 10% thinner and at least 10% taller, in comparison to legs of circulators with dielectric transformers, while still achieving good signal transfer with low loss and signal reflection.

13. The ferrite waveguide circulator of claim 10 wherein the ferrite element comprises no separate impedance matching element connected to the ferrite element.

14. The ferrite waveguide circulator of claim 10 wherein the legs of the ferrite element are provided with dimensions and a ferrite material composition such that an impedance match between a leg and a corresponding circulator port is obtained without any component being attached to the ferrite element.

15. A switch assembly comprising: a plurality of ferrite waveguide circulators, each circulator comprising: a waveguide structure having an internal cavity, the waveguide structure including a plurality of ports extending from the internal cavity, the ports being free from any steps in height or width; and a ferrite element disposed in the internal cavity and having a plurality of legs matching the number of ports, the legs terminating without any quarter wavelength dielectric transformers extending therefrom, the ferrite element being comprised of a ferrite material having a relatively high saturation magnetization value such that waveguide port steps and dielectric transformers can be omitted while still providing good impedance matching, wherein a broadband impedance match is obtained of greater than 5% of frequency bandwidth at a 21 dB isolation point and/or greater than 20% frecquency bandwidth at a 14 dB isolation point.

16. A switch as claimed in claim 15 wherein some of the ports of the waveguide structures are provided with absorptive loads associated directly therewith without any dielectric transformers positioned between the ports and the absorptive loads.

* * * * *